United States Patent [19]

Kato et al.

[11] Patent Number: 4,786,845

[45] Date of Patent: Nov. 22, 1988

[54] CATHODE RAY TUBE HAVING AN ELECTRON GUN CONSTRUCTED FOR READY REFOCUSING OF THE ELECTRON BEAM

[75] Inventors: Takefumi Kato, Hinodemachi; Toshihiro Harada; Osamu Akizuki, both of Hachioji, all of Japan

[73] Assignee: Iwatsu Electric Co., Ltd., Tokyo, Japan

[21] Appl. No.: 169,239

[22] Filed: Mar. 16, 1988

[30] Foreign Application Priority Data

Mar. 25, 1987 [JP] Japan ..... 62-71250

[51] Int. Cl.[4] ..... H01J 29/58

[52] U.S. Cl. ..... 315/382; 315/15; 315/17; 313/429

[58] Field of Search ..... 315/382, 15, 17; 313/414, 449, 429, 460

[56] References Cited

U.S. PATENT DOCUMENTS

| | | | |
|---|---|---|---|
| 3,496,406 | 2/1970 | Deschamps | 313/429 |
| 4,142,128 | 2/1979 | Odenthal | 315/15 |
| 4,188,563 | 2/1980 | Janko | 313/460 |
| 4,302,704 | 11/1981 | Saito | 315/17 |

FOREIGN PATENT DOCUMENTS

| | | |
|---|---|---|
| 0241945 | 4/1987 | European Pat. Off. . |
| 59-134531 | 8/1984 | Japan . |

*Primary Examiner*—Theodore M. Blum

*Attorney, Agent, or Firm*—Woodcock Washburn Kurtz Mackiewicz & Norris

[57] ABSTRACT

A cathode ray tube comprises a series of quadrupolar lenses for focusing a beam of electrons, emitted from a cathode at one end of an evacuated envelope under the control of a control electrode, at a target screen at the other end of the envelope. After having been focused at the target by adjustment of electric potentials on the quadrupolar lenses, the electron beam will defocus upon change in a potential on the control electrode because then the crossover or initial focusing point of the electron beam will be displaced along the central axis of the envelope. With a view to ready refocusing of the beam at the target, a refocusing lens is provided between the crossover point and the quadrupolar lenses for providing a convering lens action of radial symmetry about the envelope axis. The beam can be refocused through adjustment of a single potential on the refocusing lens rather than through adjustment of several different potentials on the quadrupolar lenses.

21 Claims, 10 Drawing Sheets

CATHODE RAY TUBE HAVING AN ELECTRON GUN CONSTRUCTED FOR READY REFOCUSING OF THE ELECTRON BEAM

BACKGROUND OF THE INVENTION

Our invention relates to cathode ray tubes (CRTs) such as those used for oscilloscopic and storage applications. More specifically, our invention pertains to improvements in or relating to CRTs of the type having a plurality of quadrupolar lenses arranged in a row along the tube axis as parts of the electron gun, the improvements being designed for easy refocusing of the beam at the screen or target.

It has been known to incorporate three quadrupolar lenses in the electron gun of CRTs and to connect them to separate variable potential sources. European patent application Publication No. 241,945 and Japanese Laid Open patent application No. 59-134531 are examples of prior art teaching such quadrupolar lenses. Supplied with proper operating potentials, the quadrupolar lenses conjointly serve to create a beam spot on the target with a minimum of out-of-roundness. A problem has existed, however, with this known type of CRT in connection with the focusing of the electron beam at the target, as discussed in more detail hereafter.

The cathode of the electron gun emits a beam of electrons following different paths depending upon a potential impressed to the control electrode. Varying the potential on the control electrode alters the paths of the electrons and thus changes the position in which they converge or cross over on the tube axis. In the prior art CRTs having three quadrupolar lenses, such shifting of the crossover point on the tube axis has required readjustment of as many as three different potentials, or even six different potentials consisting of three different positive potentials and three different negative potentials, on the constituent electrodes of the quadrupolar lenses in order to refocus the beam at the target.

SUMMARY OF THE INVENTION

We have hereby succeeded in materially simplifying the refocusing of the electron beam at the target or screen in CRTs of the class defined after each alteration in the crossover point of the beam on the tube axis through a change in the potential on the control electrode of the electron gun.

In summary, our invention is best characterized by a unipotential refocusing lens provided between the crossover point and the series of quadrupolar lenses for providing a converging lens action of radial symmetry about the tube axis. Thus the electron beam, on being defocused by a change in the potential on the control electrode, can be refocused by adjusting a single potential on the refocusing lens instead of several potentials on the quadrupolar lenses.

The above and other features and advantages of our invention and the manner of realizing them will become more apparent, and the invention itself will best be understood, from a study of the following description and appended claims, with reference had to the attached drawings showing several preferable embodiments of our invention.

Figure 14:
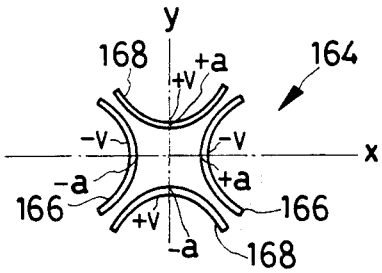
FIG. 14 PRIOR ART
Figure 8:
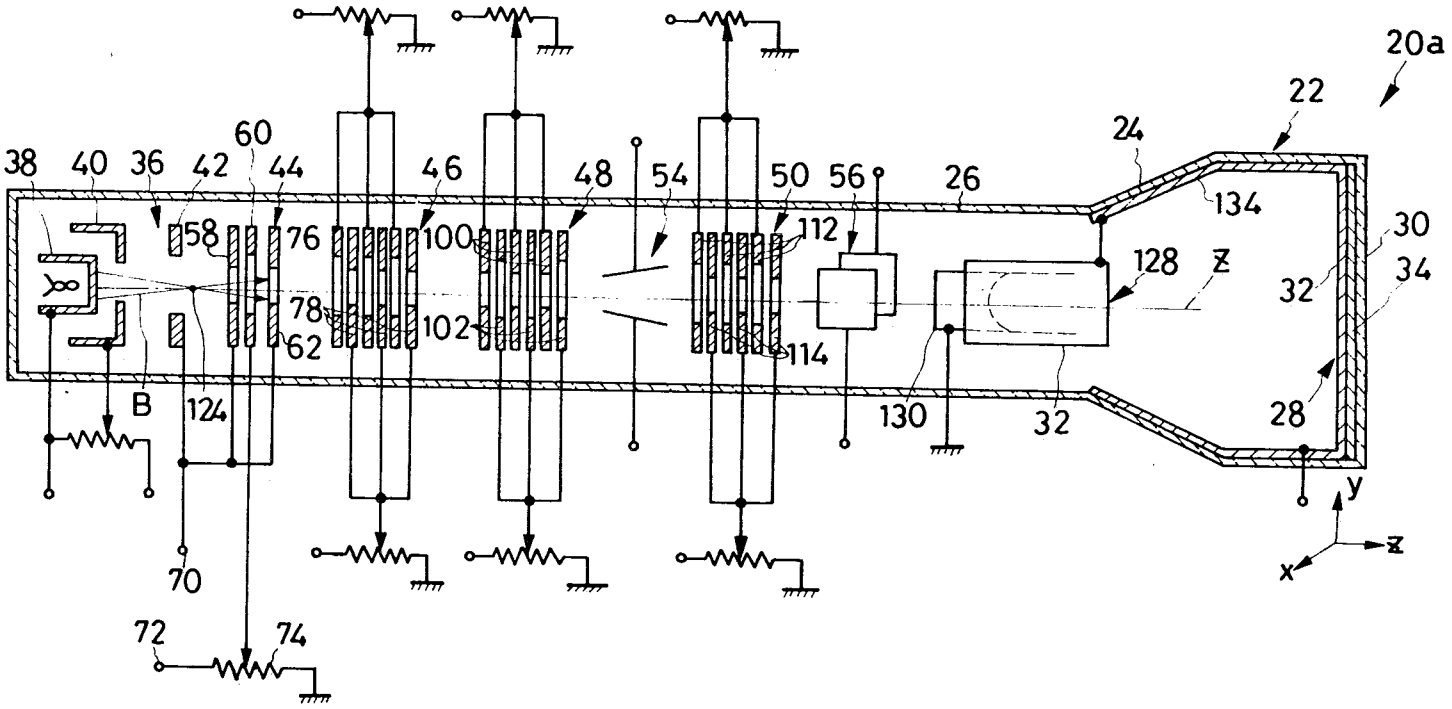
Figure 9:
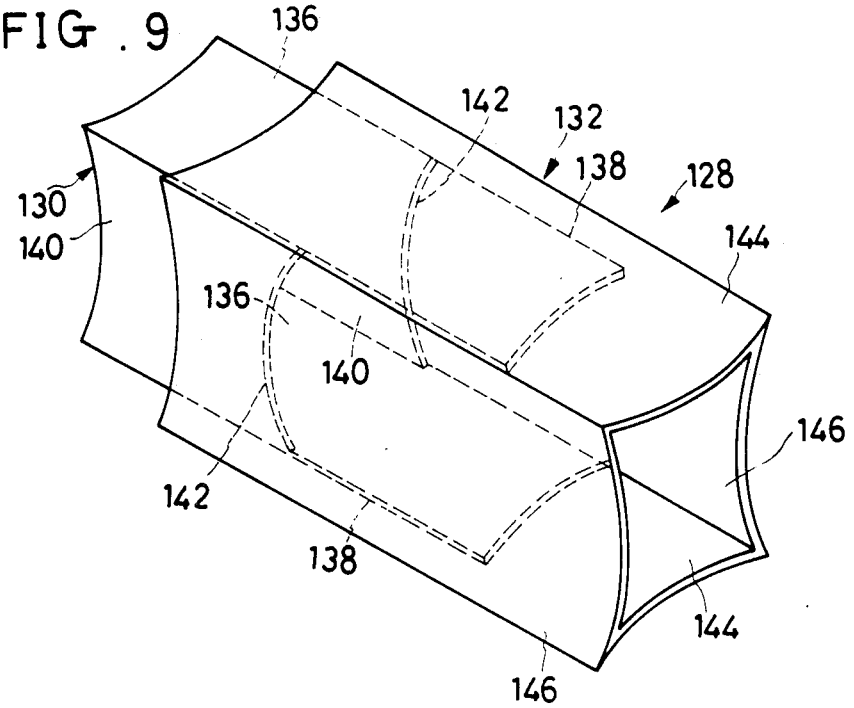
Figure 10:
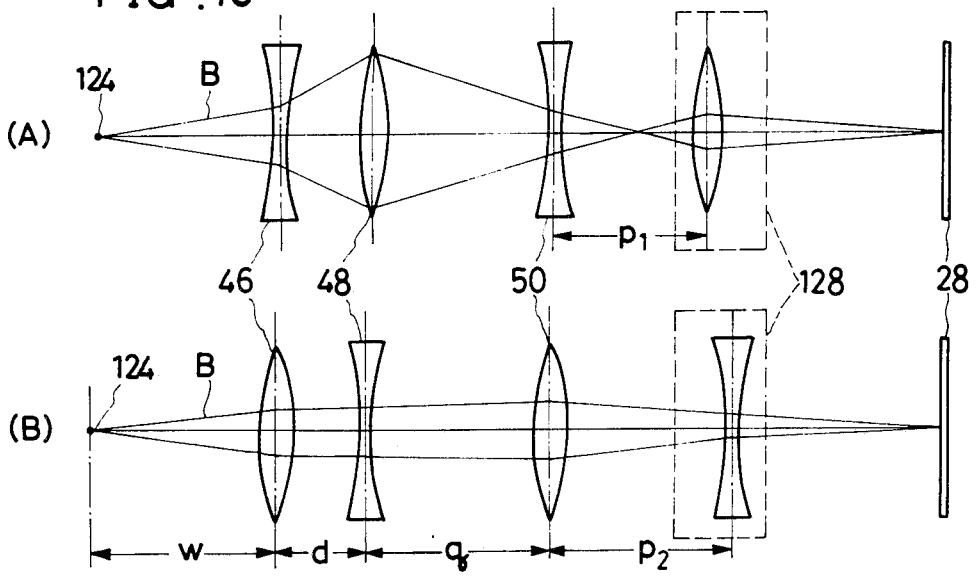
Figure 11:
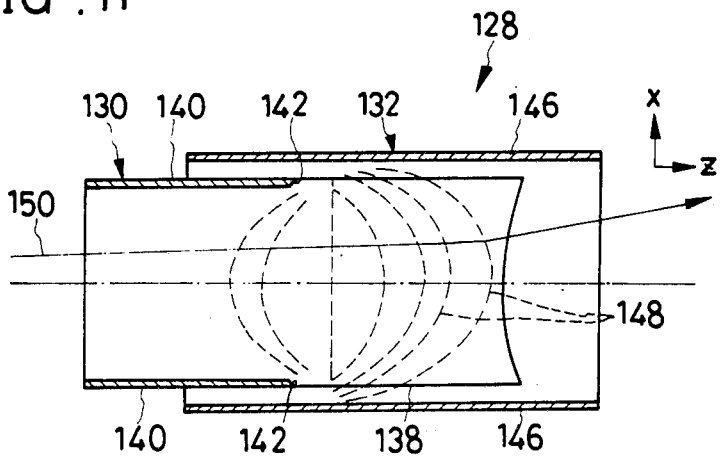
Figure 12:
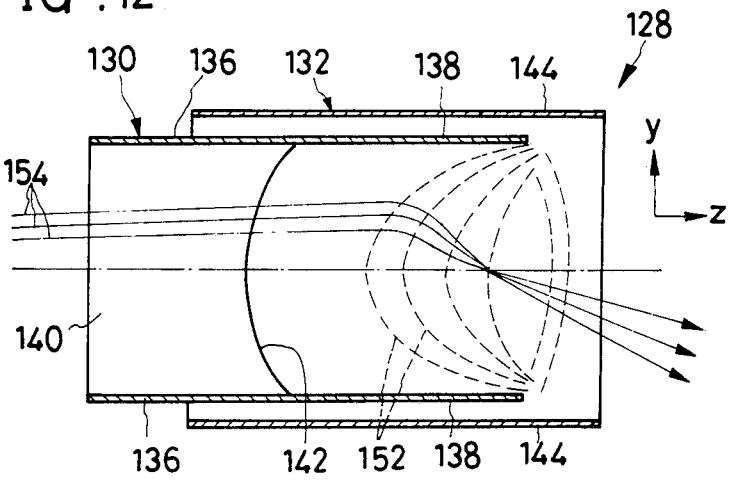
Figure 13:
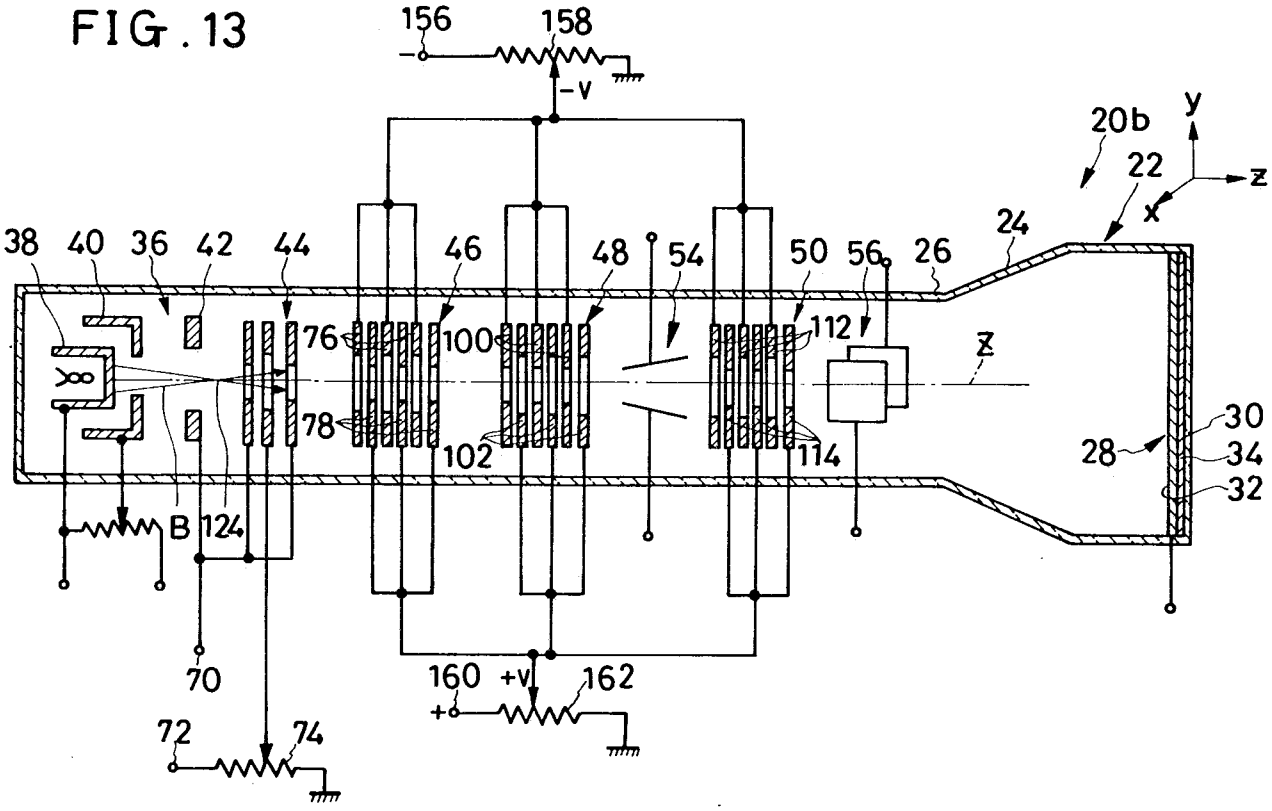
Figure 15:
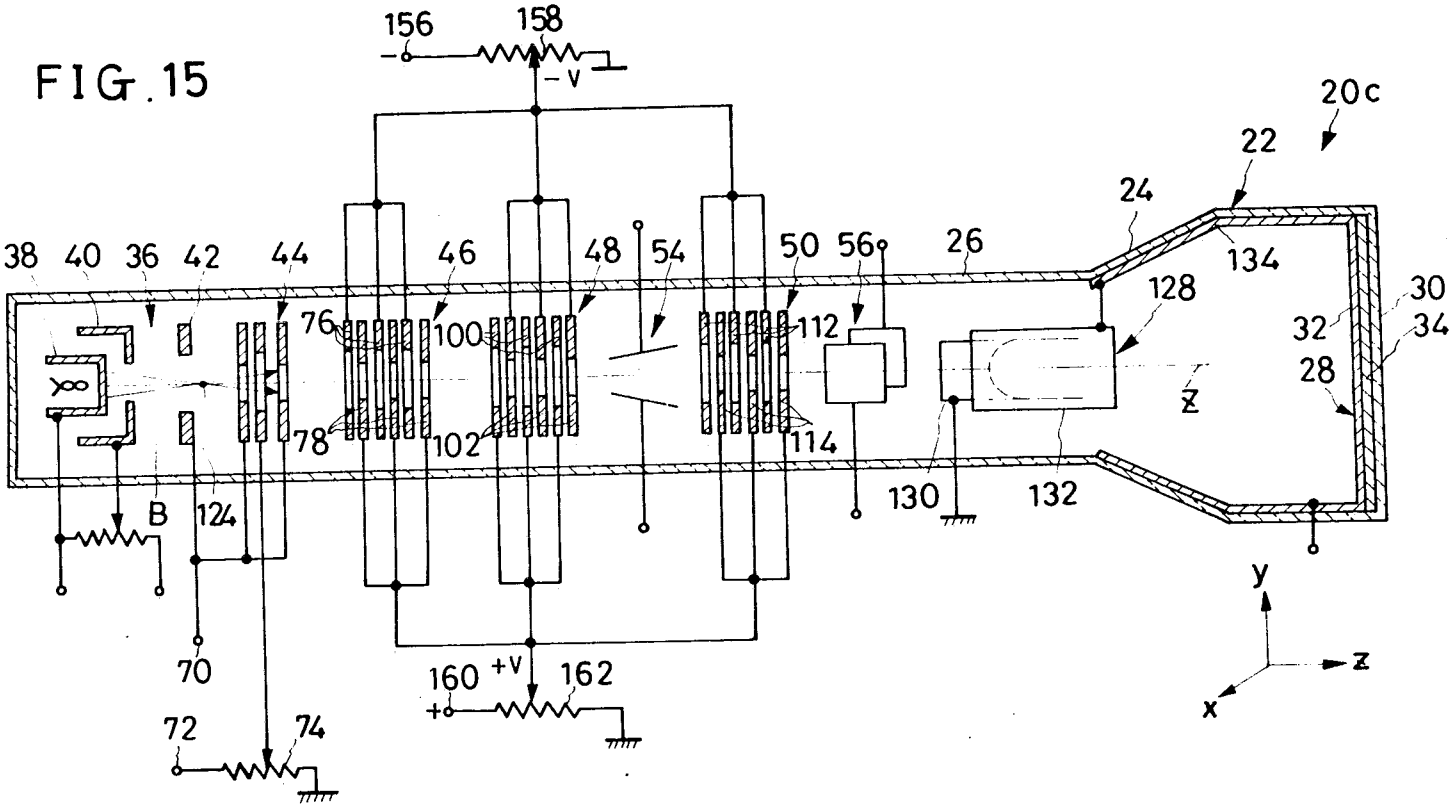
Figure 16:
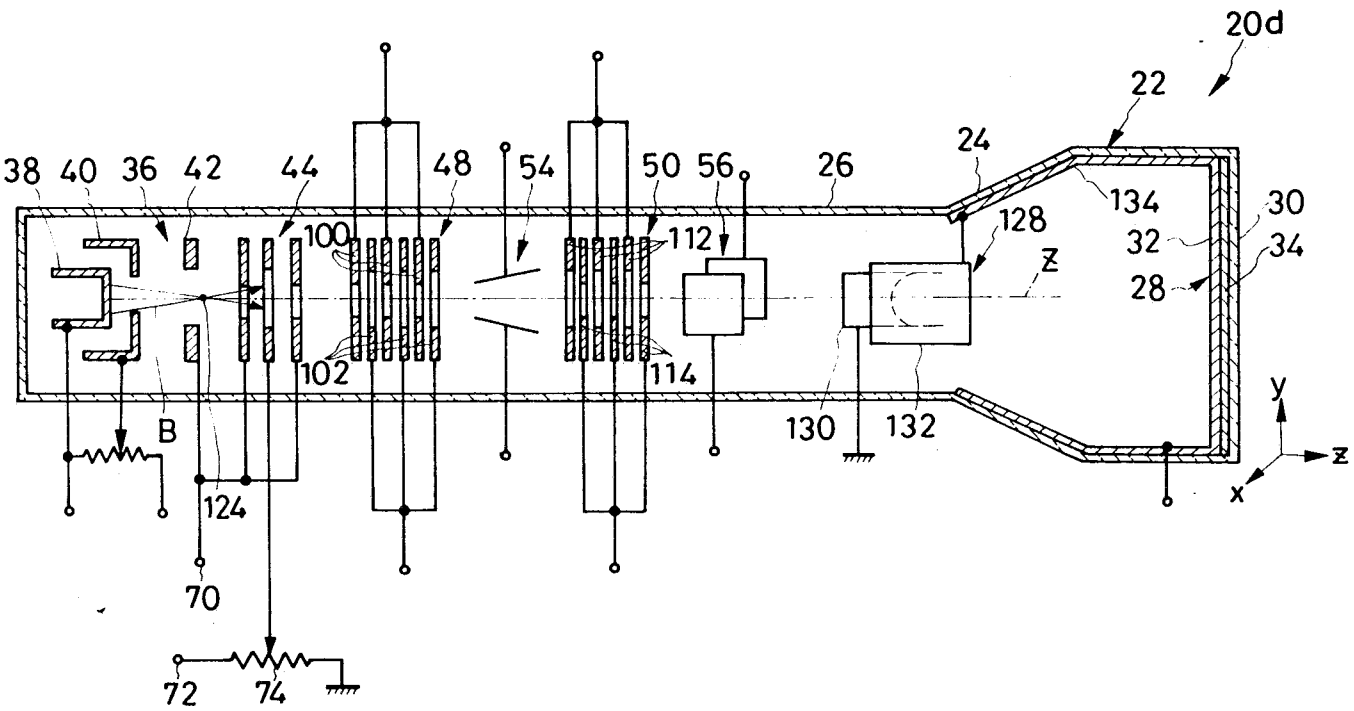
Figure 17:
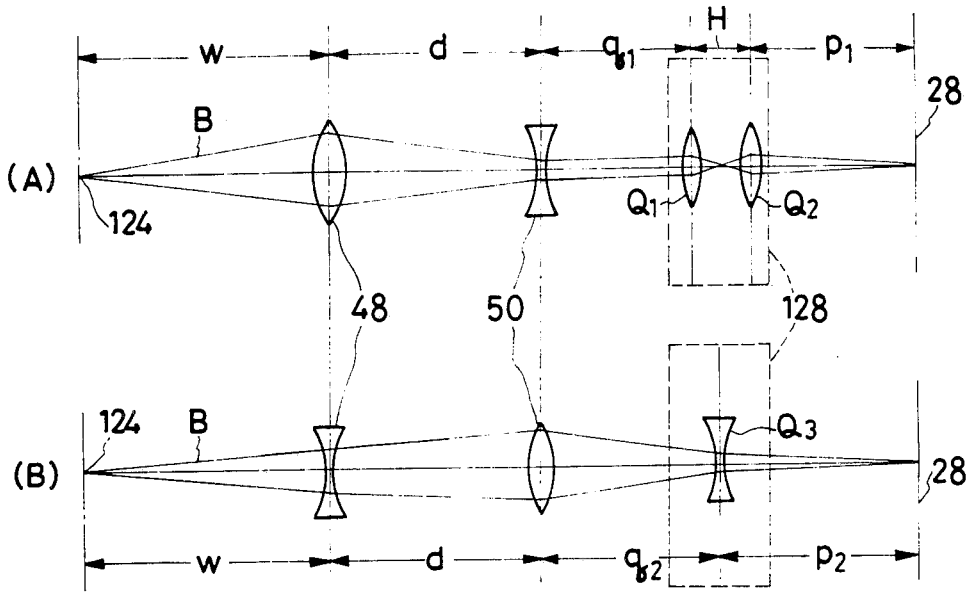
Figure 18:
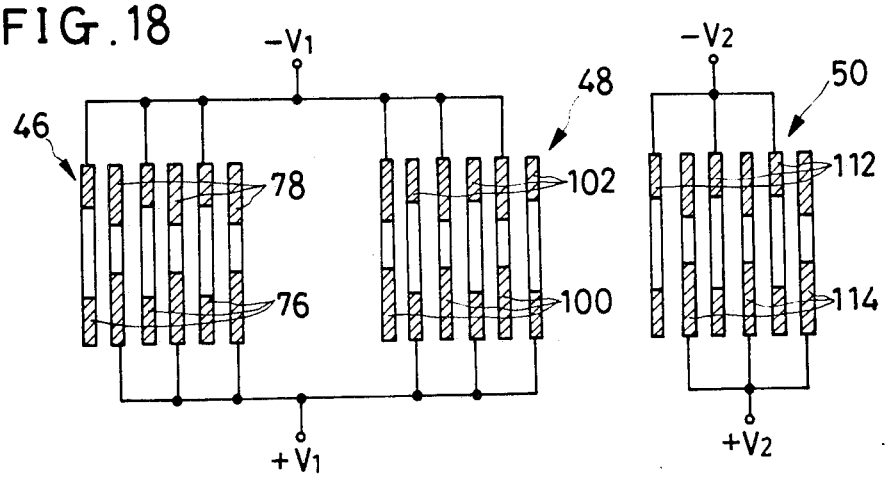

FIG. is a diagrammatic longitudinal section through another preferred form of CRT constructed in accordance with our invention, the CRT being shown together with means for applying potentials to its various working components;

FIG. 9 is an enlarged view in perspective of the scan expansion lens system in the FIG. 8 CRT;

FIG. 10, consisting of (A) and (B), is an illustration by optical analogy of the focusing actions of the three quadrupolar lenses and scan expansion lens system of the FIG. 8 CRT in two orthogonal directions;

FIG. 11 is an enlarged horizontal section through the scan expansion lens system in the FIG. 8 CRT, the view being explanatory of how the lens system operates to amplify beam deflection in one of the two orthogonal directions;

FIG. 12 is an enlarged vertical section through the scan expansion lens system in the FIG. 8 CRT, the view being explanatory of how the lens system operates to amplify beam deflection in the other of the two orthogonal directions;

FIG. 13 is a diagrammatic longitudinal section through a further preferred form of CRT constructed in accordance with our invention, the CRT being shown together means for applying potentials to its various working components;

FIG. 14 is an end elevation of a known quadrupolar lens useful in explaining the design of the quadrupolar lenses of the FIG. 13 CRT;

FIG. 15 is a diagrammatic longitudinal section through a further preferred form of CRT constructed in accordance with our invention, the CRT being shown together with means for applying potentials to its various working components;

FIG. 16 is a view similar to FIG. 15 but showing a still further preferred form of CRT in accordance with our invention;

FIG. 17, consisting of (A) and (B), is an illustration by optical analogy of the focusing actions of the two quadrupolar lenses and scan expansion lens system in the FIG. 16 CRT; and FIG. 18 is a diagrammatic of alternative means for applying potentials to the three quadrupolar lenses in the FIG. 13 CRT or the FIG. 15 CRT.

DESCRIPTION OF THE PREFERRED EMBODIMENTS

Figure 1:
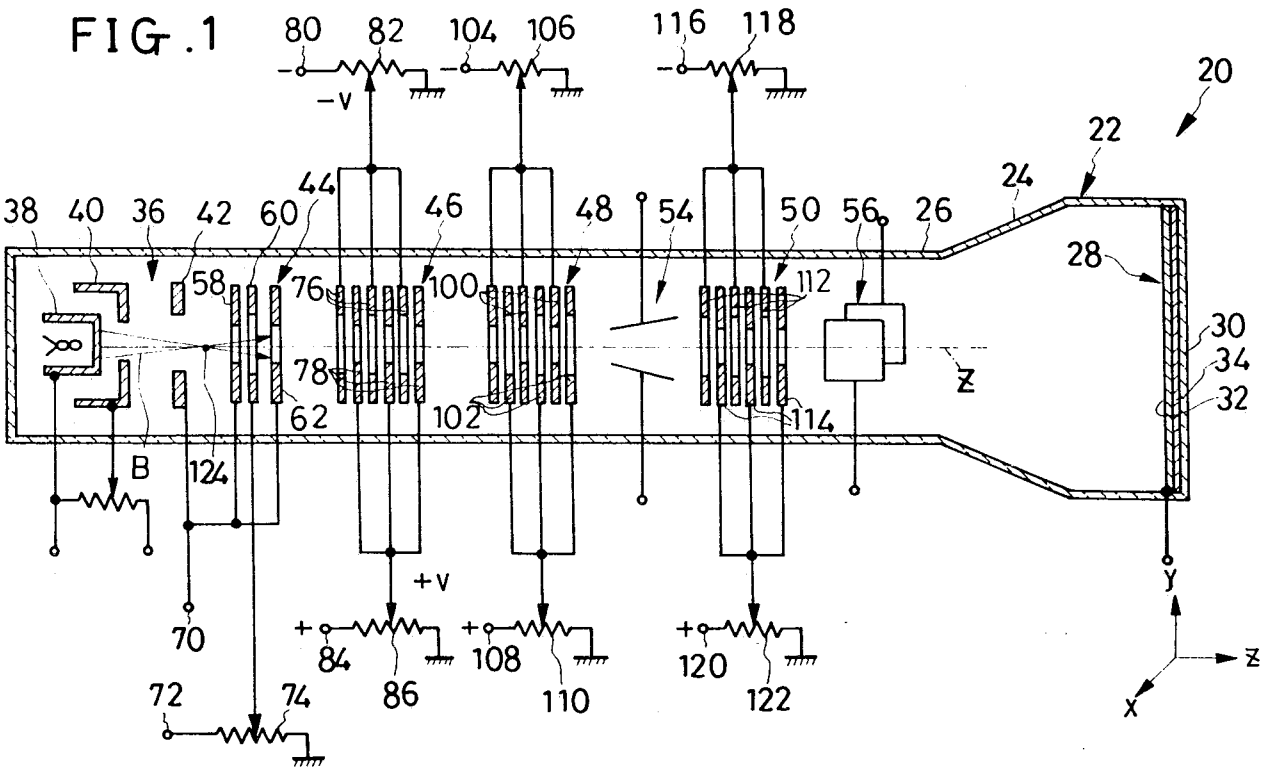
FIG. 1 is a diagrammatic longitudinal section through the CRT constructed in accordance with our invention, the CRT being shown together with means for applying potentials to its various working components.

We will now describe our invention in detail as embodied in the CRT 20 of FIG. 1 for oscilloscopic applications. The CRT 20 has a hermetically sealed, evacuated envelope 22 of glass or like rigid, electrically insulating material. The envelope 22 has a funnel portion 24 and a tubular neck portion 26 integrally joined to each other in alignment about their central axis z. We will refer to this central axis z of the envelope 22 as the tube axis or z axis, as the case may be. The envelope funnel portion 24 has a target 28 formed on the inner surface of a glass faceplate 30 constituting part of the envelope 22. The target 28 takes the form of a fluorescent screen in this particular embodiment, comprising a conductive layer 32 overlying a fluorescent coating 34 on the faceplate.

Mounted within the envelope neck portion 26 is an electron gun 36 for emitting electrons in a beam B directed toward the target 28. The electron gun 36 comprises a cathode 38, a control electrode 40, an accelerating electrode 42, a refocusing lens 44, and first 46, second 48 and third 50 unipotential quarupolar lenses, which are arranged in that order from the gun side end toward the target side end of the envelope 22 along the tube axis z.

The envelope neck portion 26 further houses a pair of vertical deflection plates 54 disposed between the second 48 and third 50 quadrupolar lenses, and a pair of horizontal deflection plates 56 disposed between the third quadrupolar lens 50 and the target 28. The deflection plate pairs 54 and 56 operate in the known manner to deflect the electron beam B vertically and horizontally, respectively. We are herein using the terms "vertical" and "horizontal", and derivatives thereof, in accordance with common parlance in the art. Actually, all that is required is that the beam be deflected in two orthogonal directions x and y in a plane at right angles with the tube axis z.

Figure 2:
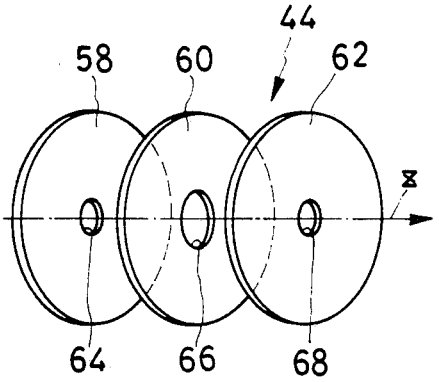
FIG. 2 is an enlarged view in perspective of the refocusing lens in the FIG. 1 CRT.

As better illustrated in FIG. 2, the refocusing lens 44 constituting the gist of our invention is a unipotential electrostatic lens capable of providing a converging lens action of radial symmetry about the tube axis z for controlling the spot size of the electron beam B at the target 28. It comprises three spaced apart, planar electrodes 58, 60 and 62, herein shown as discs having apertures or holes 64, 66 and 68 of circular shape defined centrally therein, which are arranged in a row and in alignment about the tube axis z.

It will be noted by referring back to FIG. 1 that the first or cathode side electrode 58 and third or target side electrode 62 of the refocusing lens 44 are both electrically connected to the same supply terminal 70 as is the accelerating electrode 42. The second or intermediate refocusing electrode 60 is electrically connected to a different supply terminal 72 via a variable resistor 74. The variable potential applied to the intermediate refocusing electrode 60 is lower than the fixed potential applied to the other two refocusing electrodes 58 and 62 as well as to the accelerating electrode 42.

Figure 3:
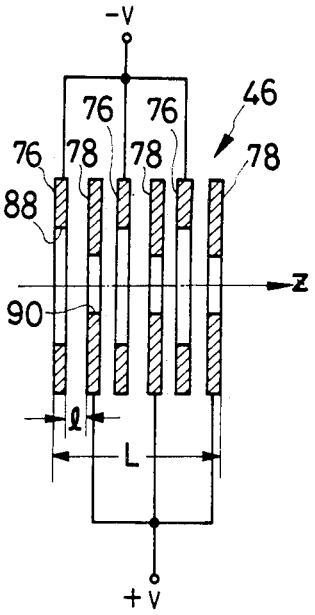
FIG. 3 is an enlarged axial section through the first quadrupolar lens in the FIG. 1 CRT.

As shown in both FIGS. 1 and 3, the first quadrupolar lens 46 is an alternating arrangement of a first group of three planar or disclike electrodes 76 and a second group of three similar electrodes 78, all in alignment about the tube axis z and with constant spacings 1 therebetween. The first group of electrodes 76 are jointly connected to a negative supply terminal 80 via a variable resistor 82. The second group of electrodes 78 are jointly connected to a positive supply terminal 84 via a variable resistor 86.

Figure 4:
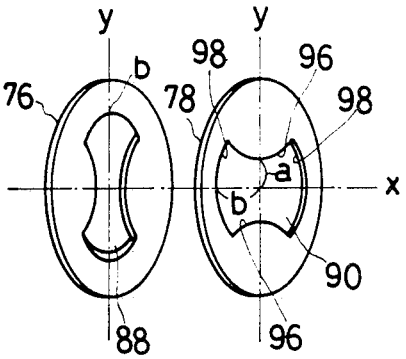
FIG. 4 is an enlarged view in perspective of two representative ones of the constituent electrodes of the first quadrupolar lens in the FIG. 1 CRT.

FIG. 4 shows in perspective one of the first group of electrodes 76, and one of the second group of electrodes 78, of the first quadrupolar lens 46 in their relative angular positions about the tube axis, it being understood that the two others of the first group of electrodes and the two others of the second group of electrodes are identical in construction with the two representative electrodes 76 and 78, respectively, shown here. It will be seen that each first electrode 76 and each second electrode 78 have apertures 88 and 90 formed respectively therein.

Figure 5:
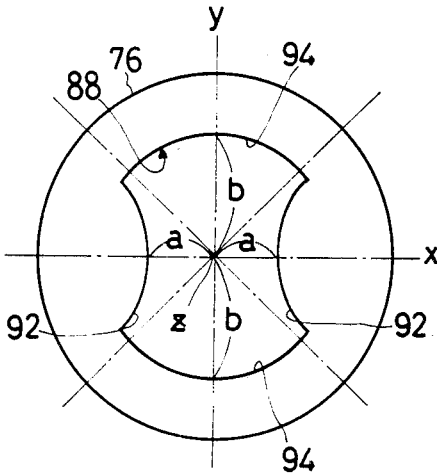
FIG. 5 is a still more enlarged elevation of one of the two representative electrodes of FIG. 4.

We will refer to FIG. 5 for a discussion of the shape of the aperture 88 in each first electrode 76 of the first quadrupolar lens 46. The aperture is defined by a first pair of opposite convex edges 92 disposed in symmetrically on both sides of the yz plane, and a second pair of opposite concave edges 94 disposed symmetrically on both sides of the xz plane. Let a be the distance along the x axis between each convex edge 92 and the intersection of the x and y axes, and b the distance along the y axis between each concave edge 94 and the intersection of the x and y axes. The distance b is significantly more than, typically twice, the distance a. Further each convex edge 92 is curved approximately in accordance with the formula, $x^2-y^2=a^2$, which represents the equilateral hyperbola. Each concave edge 94 is curved approximately in accordance with the formula, $x^2+y^2=b^2$, which represents the circle. It is pricipally the pair of convex edges 92 that determines the lens action of the quadrupolar lens 46. Being spaced farther away from the tube axis z, the pair of concave edges 94 does not appreciably affect the lens action of the quadrupolar lens 46.

As will be noted from FIG. 4, the aperture 90 in each second electrode 78 of the first quadrupolar lens 46 is identical in shape and size with the above described aperture 88 in each first electrode 76 thereof; only, the aperture 90 is angularly displaced 90 degrees about the tube axis z from the aperture 88. Thus the aperture 90 is defined by a pair of opposed convex edges 96 disposed symmetrically on both sides of the xz plane and by a pair of opposed concave edges 98 disposed symmetrically on both sides of the yz plane.

With reference back to FIG. 1 the second quadrupolar lens 48 is also an alternating arrangement of a first group of three planar or disclike electrodes 100 and a second group of three similar electrodes 102, all in alignment about the tube axis z and with constant spacings therebetween. The first group of electrodes 100 are jointly connected to a negative supply terminal 104 via a variable resistor 106. The second group of electrodes 102 are jointly connected to a positive supply terminal 108 via a variable resistor 110.

The third quadrupolar lens 50 is likewise an alternating arrangement of a first group of three planar or disclike electrodes 112 and a second group of three similar electrodes 114, all in alignment about the tube axis z and with constant spacings therebetween. The first group of electrodes 112 are jointly connected to a negative supply terminal 116 via a variable resistor 118. The second group of electrodes 114 are jointly connected to a positive supply terminal 120 via a variable resistor 122.

The second 48 and third 50 quadrupolar lenses are each constructed on the same principle as is the first quadrupolar lens 46. However, the second group of electrodes 102 of the second quadrupolar lens 48 and the first group of electrodes 112 of the third quadrupolar lens 50 have each an aperture of substantially the same shape and size as the aperture 88 of each of the first group of electrodes 76 of the first quadrupolar lens 46. The first group of electrodes 100 of the second quadrupolar lens 48 and the second group of electrodes 114 of the third quadrupolar lens 50 have each an aperture of substantially the same shape and size as the aperture 90 of each of the second group of electrodes 78 of the first quadrupolar lens 46.

Figure 6:
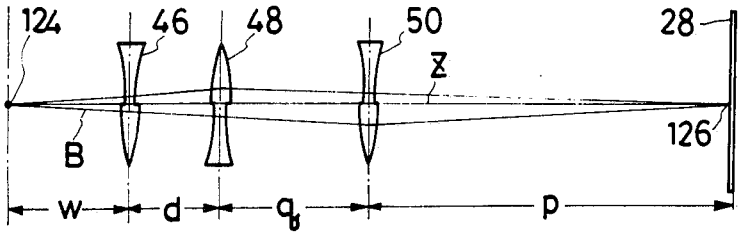
FIG. 6 is an illustration by optical analogy of the focusing actions of the three quadrupolar lenses of the FIG. 1 CRT in two orthogonal directions.

We will now explain the vertical and horizontal focusing of the electron beam B by the three quadrupolar lenses 46, 48 and 50 by optical analogy with reference to FIG. 6. The upper half of this figure, above the tube axis z, illustrates the vertical lens actions of the quadrupolar lenses 46, 48 and 50, whereas the lower half of the figure illustrates the horizontal lens actions of the quadrupolar lenses. It will be seen that the first quadrupolar lens 46 acts as concave lens vertically and as convex lens horizontally, the second quadrupolar lens 48 as convex lens vertically and as concave lens horizontally, and the third quadrupolar lens 50 as concave lens vertically and as convex lens horizontally.

At 124 in FIG. 6 is indicated the crossover point at which the paths of the electrons issuing from the cathode 38 under the control of the control electrode 40 converge and cross over on the tube axis z. This crossover point is also indicated by the same reference numeral in FIG. 1. In FIG. 6 we have disregarded the focusing action of the refocusing electrode 44 in order to clearly illustrate the actions of only the three quadrupolar lenses 46, 48 and 50.

Let us assume that the vertical and horizontal magnifications of the beam spot 126 at the target 28 are the same. Then the reciprocals S1, S2 and S3 of the focal lenths of the respective quadrupolar lenses 46, 48 and 50 can be expressed as:

$$S1=[q(d+w)(d+w+q+p)/dw^2(d+q)(q+p)]^{\frac{1}{2}} \quad (1)$$

$$S2=[(d+q)(d+w+q+p)/dq(d+w)(q+p)]^{\frac{1}{2}} \quad (2)$$

$$S3=[d(q+p)(d+w+q+p)/q^2(d+w)(q+d)]^{\frac{1}{2}} \quad (3)$$

where w = the distance between crossover point 124 and the center of the first quadrupolar lens 46;

d = the center-to-center distance between the first 46 and second 48 quadrupolar lenses;

q = the center-to-center distance between the second 48 and third 50 quadrupolar lenses; and p = the distance between the center of the third quadrupolar lens 50 and the target 28.

Thus, even were it not for the refocusing lens 44 in accordance with our invention, a round spot would appear on the target 28 through adjustment of the constants of the three quadrupolar lenses 46, 48 and 50. However, as has been set forth, we object to the prior art because of difficulties involved in refocusing the beam at the target 28 after the beam has defocused through a change in the potential on the control electrode 40 of the electron gun 36. Any alteration of the control electrode potential results in the displacement of the crossover point 124 on the tube axis z. For example, with an increase in the control electrode potential, the distance w between the crossover point 124 and the center of the first quadrupolar lens 46 will decrease, resulting in the defocusing of the beam at the target 28. The refocusing of the beam has heretofore required the readjustment of the total of six (three positive and three negative) potentials on the three quadrupolar lenses 46, 48 and 50. We have materially simplified such beam refocusing by interposing the refocusing lens 44 between the crossover point 124 and the first quadrupolar lens 46.

Figure 7:
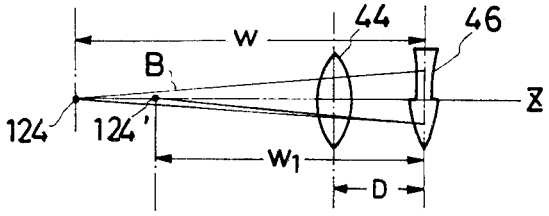
FIG. 7 is an illustration by optical analogy of how the refocusing lens operates to refocus the electron beam in the FIG. 1 CRT.

FIG. 7 is explanatory of how the beam B is refocused through a simple readjustment of the potential on only the refocusing lens 44 which is herein shown as a convex lens by optical analogy. Let us suppose that the crossover point of the convergent electron beam issuing from the cathode 38 has shifted from 124 to 124' along the tube axis z through a change in the potential on the control electrode 40, resulting in the defocusing of the beam which has been in focus through preadjustment of the six required operating voltages on the three quadrupolar lenses 46, 48 and 50. The defocusing is attributable in this case to the decrease of the distance between the crossover point and the center of the first quadrupolar lens 46 from W to W1 because of the displacement of the crossover point from 124 to 124'.

Therefore, for refocusing, the potential on the refocusing lens 44 may be readjusted so as to satisfy the equation:

$$S=1/(W1-D)-1/(W-D) \quad (4)$$

where S is the reciprocal of the focal length of the refocusing lens 44 and D is the center-to-center distance between the refocusing lens 44 and the first quadrupolar lens 46.

This readjustment of the potential on the refocusing 44 is tantamount to returning the image point of the first quadrupolar lens 46 to a position of the distance W from that of the distance W1, that is, to returning the crossover point from 124' to 124. It is thus seen that the beam B can be refocused at the target 28 only through readjustment of the potential on the refocusing lens 44. No alteration of the preadjusted potentials on the three quadrupolar lenses 46, 48 and 50 is required.

We have gained another important advantage through use of the refocusing lens 44. The conventional refocusing operation by the three quadrupolar lenses 46, 48 and 50 has been very poor in response by reason of the large capacitances between their six constituent electrodes. The total capacitance of the three element refocusing lens 44 in accordance with our invention is so much less than that of the quadrupolar lenses 46, 48 and 50 that its response is far quicker than heretofore.

EMBODIMENT OF FIGS. 8-12

As illustrated in FIG. 8, the refocusing lens 44 of our invention lends itself to use in a CRT 20*a* having a scan expansion lens system 128 of the type described and claimed in the noted European patent application Publication No. 241,945. Disposed between the pair of horizontal deflection plates 56 and the target 28, the scan expansion lens system 128 is a bipotential quadrupolar lens comprising first 130 and second 132 boxlike electrodes, with the first electrode 130 disposed closer to the electron gun 36 and partly nested in the second electrode 132 with an insulating gap therebetween. The CRT 20*a* additionally comprises a postaccelerating electrode 134 herein shown as a conductive coating on the inside surface of the funnel portion 24 of the envelope 22 in electrically conducting relation to the conductive layer 32 of the target 28. The postaccelerating electrode 134 is further electrically connected to the second or target side electrode 132 of the scan expansion lens system 128. The gun side electrode 130 is grounded. The CRT 20*a* is akin in the other details of construction to the CRT 20 of FIG. 1.

We have illustrated the scan expansion lens system 128 in more detail in FIG. 9. The gun side electrode 130 comprises a first pair of opposite sides 136 disposed symmetrically on both sides of the xz plane and having a pair of tongues 138 extending therefrom toward the target, and a second pair of opposite sides 140 disposed symmetrically on both sides of the yz plane and each having a side edge 142 that is curved in an arc convexed toward the electron gun. The target side electrode 132 comprises a first pair of opposite sides 144 disposed symmetrically on both sides of the xz plane, and a second pair of opposite sides 146 disposed symmetrically on both sides of the yz plane. As seen from either end of the lens system 128, the four sides 136 and 140 of the gun side electrode 130 and the four sides 144 and 146 of the target side electrode 132 are all convexed toward the tube axis z with a hyperbolic or similar curve.

At (A) and (B) in FIG. 10 are illustrated by optical analogy the vertical and horizontal focusing actions, respectively, of the three quadrupolar lenses 46, 48 and 50 and scan expansion lens sytem 128 of the CRT 20*a*. It will be seen from these illustrations that the scan expansion lens system 128 acts as a converging lens vertically and as a diverging lens horizontally. The converging lens is disposed at a distance P1 from the third quadrupolar lens 50, and the diverging lens at a different distance P2 therefrom, because of the different locations in which they are created within the scan expansion lens system 128.

FIGS. 11 and 12 are explanatory of how the scan expansion lens system 128 operates to magnify the horizontal and vertical deflections, respectively, of the electron beam. FIG. 11 shows at 148 the horizontal distribution of equipotential lines created largely between the pair of tongues 138 of the gun side electrode 130 of the scan expansion lens system 128 upon application of prescribed potentials to its two constituent electrodes 130 and 132. The line 150 indicates one of the opposite extreme trajectories of the electron beam that has been deflected horizontally. The equipotentials 148 act to magnify the horizontal deflection of the beam as represented by the line 150.

In FIG. 12, on the other hand, is shown the vertical distribution of equipotential lines 152 created adjacent the target side ends of the gun side electrode tongues 138 of the scan expansion lens system 128. As indicated by lines 154 representing some of the trajectories of the beam that has been deflected vertically, the equipotentials 152 expand the vertical beam deflection by inverting the trajectories 154 with respect to the z axis in the vertical plane.

We believe it apparent from the foregoing that the refocusing lens 44 functions in the FIG. 8 CRT 20*a* in the same way as in the FIG. 1 CRT 20 to refocus the beam B at the target 28. Thus, in the CRT 20*a* including the scan expansion lens system 128, we have gained the same advantages as set forth in conjunction with the CRT 20.

EMBODIMENT OF FIG. 13

FIG. 13 shows a further preferred form of CRT 20*b* in accordance with our invention. This CRT 20*b* is analogous in construction with the FIG. 1 CRT 20 except for different means employed for applying potentials to the three quadrupolar lenses 46, 48 and 50. The first groups of electrodes 76, 100 and 112 of all the quadrupolar lenses 46, 48 and 50 are connected in common to a negative supply terminal 156 via a variable resistor 158. The second groups of electrodes 78, 102 and 114 of all the quadrupolar lenses 46, 48 and 50 are connected in common to a positive supply terminal 160 via a variable resistor 162. The negative potential $-V$ impressed to the first groups of electrodes 76, 100 and 112 is equal in absolute value to the positive potential $+V$ applied to the second groups of electrodes 78, 102 and 114.

The application of the voltages of the same absolute value and opposite polarities to the first and second groups of electrodes of the quadrupolar lenses 46, 48 and 50 becomes possible by taking either of the following two measures:

1. Appropriate determination of the constants of the hyperbolic curves of the pair of opposed edges 92 of the aperture 88, and of the pair of opposite edges 96 of the aperture 90, in each electrode of all the quadrupolar lenses 46, 48 and 50.

2. Appropriate determination of the dimension L, FIG. 3, of each of the quadrupolar lenses 46, 48 and 50 along the tube axis z, with the constants of the hyperbolic curves of the edges 92 and 96 of the apertures 88 and 90 in all the quadrupolar lens electrodes maintained constant.

We will explain the first recited measure in more detail with reference to FIG. 14 which shows a prior art unipotential quadrupolar lens 164 of seemingly ideal design. It comprises a first pair of opposed electrodes 166 convexed toward each other and disposed symmetrically on both sides of the yz plane, and a second pair of opposed electrodes 168 also convexed toward each other and disposed symmetrically on both sides of the xz plane. The first pair of electrodes 166 are each curved hyperbolically in accordance with the formula, $x^2-y^2=a^2$, whereas the second pair of electrodes 168 are each curved in accordance with the formula, $x^2-y^2=-a^2$. A negative voltage $-V$ is impressed to the first pair of electrodes 166, and a positive voltage $+V$ to the second pair of electrodes 168.

The potential $\phi$ in the space bounded by the two pairs of electrodes 166 and 168 can be approximately expressed as:

$$\phi=V/a^2(x^2-y^2). \tag{5}$$

The reciprocal S of the focal length of this prior art lens is defined as:

$$S\alpha 2V/a^2. \tag{6}$$

Let L be the dimension of each of the electrodes 166 and 168 along the z axis, and C the proportionality constant of the lens system. Then, if we disregard the lens actions due to potential distributions adjacent both lens ends in the z axis direction, the reciprocal S of the focal length can be redefined as:

$$S=CLV/a^2. \tag{7}$$

If we assume that the three quadrupolar lenses 46, 48 and 50 of the FIG. 13 CRT 20*b* is each an ideal quadrupolar lens equivalent to the lens 164 of FIG. 14, it follows from Equations (1), (2) and (3) that:

$$S2/S1=w(q+d)/q(d+w) \tag{8}$$

$$S3/S1=dw(q+p)/dp(d+w). \tag{9}$$

Let a1, a2 and a3 be the apexes of the hyperbolic curves of the quadrupolar lenses 46, 48 and 50; L1, L2 and L3 the dimensions of the lenses 46, 48 and 50 along the z axis; and V the applied voltage. From Equation (7), $$S1=CL1V/a1^2 \quad (10)$$

$$S2=CL2V/a2^2 \quad (11)$$

$$S3=CL3V/a3^2. \quad (12)$$

The values of a1, a2, a3, L1, L2 and L3 may be determined as follows in order to enable the application of the voltages +V and 1 V of the same absolute value to the three quadrupolar lenses 46, 48 and 50 as in the CRT 20*b* of FIG. 13.

First of all, the values of a1, L1 and V for the first quadrupolar lens 46 may be determined in accordance with Equations (1) and (10). As will be seen by referring to FIG. 6, the values of w, d, q and p in Equation (1) are determined by the arrangement of the pertinent components of the CRT, and so is the value of S1. It is therefore easy to determine the values of a1, L1 and V in accordance with Equation (10) so as to meet the known value of S1.

Equations (8) and (9) can be rewritten as:

$$S2=w(q+d)/q(d+w)\cdot S1 \quad (13)$$

$$S3=dw(q+p)/dp(d+w)\cdot S1. \quad (14)$$

Substituting the right hand sides of Equations (10), (11) and (12) for S1, S2 and S3 in Equations (13) and (14), $$L2/a2^2=w(q+d)/q(d+w)\cdot L1/A1^2 \quad (15)$$

$$L3/a3^2=dw(q+p)/qp(d+w)\cdot L1/A1^2. \quad (16)$$

If the z axis dimensions L1, L2 and L3 of the three quadrupolar lenses 46, 48 and 50 are the same, Equations (15) and (16) can be rewritten as:

$$a2=\sqrt{q(d+w)/w(q+d)}\cdot a1 \quad (17)$$

$$a3=\sqrt{qp(d+w)/dw(q+p)}\cdot a2. \quad (18)$$

The values of a1, q, d and w in Equation (17) are known. Therefore, if the apex a2 of the hyperbola of the second quadrupolar lens 48 is determined so as to satisfy Equation (17), it follows that the same potential can be impressed to the second quadrupolar lens 48 as to the first quadrupolar lens 46.

If we know the value of A2 from Equation (17), the value of A3 is ascertainable from Equation (18). Consequently, the same potential can be impressed to the third quadrupolar lens 50 as to the first 46 and second 48 quadrupolar lenses if the apex a3 of the hyperbola of the third quadrupolar lens 50 is determined so as to satisfy Equation (18).

In order to realize the second mentioned measure for the application of positive and negative voltages of the same absolute value to the first and second groups of electrodes of the three quadrupolar lenses 46, 48 and 50 of the CRT 20*b*, the constants a1, a2 and a3 of the hyperbolas of the quadrupolar lenses 46, 48 and 50 may be set at the same value. From Equations (15) and (16), $$L2=w(q+d)/q(d+w)\cdot L1 \quad (19)$$

$$L3=dw(q+p)/qp(d+w)\cdot L1 \quad (20)$$

Thus the application of positive and negative voltages of the same absolute value to the three quadrupolar lenses 46, 48 and 50 becomes possible if, after determination of the axial length L1 of the first lens 46, the axial lengths L2 and L3 of the second 48 and third 50 lenses are determiend so as to satisfy Equations (19) and (20). The required axial lengths L1, L2 and L3 of the quadrupolar lenses 46, 48 and 50 may be realized by adjustment of either the spacings l between their constituent electrodes 76, 78, 100, 102, 112 and 114 or the numbers of such electrodes.

In the foregoing discussion of how to make possible the application of positive and negative voltages of the same absolute value to the three quadrupolar lenses 46, 48 and 50, we have disregarded their terminal lens actions due to potential distributions adjacent the opposite axial ends of each lens. Actually, however, such terminal lens actions must be taken into consideration in the determination of the constants a1, a2 and a3 or of the axial lengths L1, L2 and L3.

Thus, in the CRT 20*b* constructed as in FIG. 13, the electron beam B may be focused on the target 28 by application of the appropriate positive and negative voltages of the same absolute value to the three quadrupolar lenses 46, 48 and 50. The beam will defocus, however, if the voltage on the control electrode 40 is altered, as has been explained in connection with the FIG. 1 CRT 20. In that case the beam may be refocused by readjustment of the voltage on the refocusing lens 44 rather than of the voltages on the quadrupolar lenses 46, 48 and 50.

The CRT 20*b* possesses the advantage over the FIG. 1 CRT 20 or FIG. 8 20*a* that the three quadrupolar lenses 46, 48 and 50 demand only two positive and negative voltage sources. The simpler voltage source means of the CRT 20*b* makes the complete CRT system appreciably smaller in size and less expensive in construction.

EMBODIMENT OF FIG. 15

The CRT 20*c* shown in FIG. 15 is equivalent to the FIG. 8 CRT 20*a* in having the scan expansion lens system 128, and to the FIG. 13 CRT 20*b* in having the means for impressing only two different potentials to the three quadrupolar lenses 46, 48 and 50. The other constructional details of the CRT 20*c*, including the refocusing lens 44, can be as set forth in connection with the FIG. 1 CRT 20.

We have described with reference to FIG. 10 how the scan expansion lens system 128 coacts with the three quadrupolar lenses 46, 48 and 50 to focus the beam on the target 28 in both vertical and horizontal directions in the FIG. 8 CRT 20*a*. It is therefore self evident that in the FIG. 15 CRT 20*c*, too, the quadrupolar lenses 46, 48 and 50 can focus the beam on the target 28 in coaction with the scan expansion lens system 128 through appropriate determination of the lens parameters even though only two different potentials are applied to the quadrupolar lenses.

EMBODIMENT OF FIGS. 16–17

The CRT 20*d* shown in FIG. 16 is similar in construction to the FIG. 8 CRT 20*a* except that the first quadrupolar lens 46 of the latter is absent from the former. Thus the CRT 20*d* has but two quadrupolar lenses 46 and 48, one between refocusing lens 44 and vertical deflection plate pair 54, and the other between vertical and horizontal deflection plate pairs 54 and 56. The two quadrupolar lenses 46 and 48 coact with the scan expansion lens system 128 for focusing the beam B at the target 28, as will be detailed subsequently. Therefore, in this embodiment, the scan expansion lens system 128 may be thought of as the third quadrupolar lens.

FIG. 17 illustrates at (A) and (B) how the two quadrupolar lenses 48 and 50 and scan expansion lens system 128 of the CRT 20*d* act to focus the electron beam B at the target 28 in vertical and horizontal directions, respectively. The first quadrupolar lens 48 acts as a converging lens vertically and as a diverging lens horizontally. The second quadrupolar lens 50 acts as a diverging lens vertically and as a converging lens horizontally. The scan expansion lens system 128 provides two successive converging lenses Q1 and Q2 vertically and a diverging lens Q3 horizontally.

As shown at (A) in FIG. 17, the vertical focusing action of the complete lens system is such that the electron beam B, diverging after having been focused at the crossover point 124, is converged by the first quadrupolar lens 48, and then diverged by the second quadrupolar lens 50 so that the electrons follow nearly parallel paths. Within the scan expansion lens system 128 the beam B is first strongly converged by the first lens Q1 and, impinging on the second lens Q2 in a diverging state, is thereby reconverged and focused at the target 28.

Horizontally, as illustrated at (B) in FIG. 17, the electron beam B is diverged by the first quadrupolar lens 48, then converged by the second quadrupolar lens 50, and then diverged by the lens Q3 of the scan expansion lens system 128, thereby to be focused at the target 28.

In this CRT 20*d*, however, a round spot is unobtainable on the target 28 merely through adjustment of the potentials on the two quadrupolar lenses 48 and 50. The converging and diverging actions of the lenses Q1, Q2 and Q3 of the scan expansion lens system 128 are not adjustable, either, because its two electrodes 130 and 132 are held at fixed potentials.

We suggest, therefore, that the positions of the two quadrupolar lenses be varied along the tube axis z in order to realize a round spot. We will use the following symbols, all indicated in FIG. 17, for the subsequent mathematical study of how to obtain a round spot in the CRT 20*d*:

- w = the distance between the crossover point 124 and the center of the quadrupolar lens 48;
- d = the center-to-center distance between the quadrupolar lense 48 and 50;
- q1 = the center-to-center distance between the quadrupolar lens 50 and the converging lens Q1 of the scan expansion lens system 128;
- q2 = the center-to-center distance between the quadrupolar lens 50 and the diverging lens Q3 of the lens system 128;
- H = the center-to-center distance between the converging lenses Q1 and Q2 of the lens system 128;
- p1 = the distance between the converging lens Q2 and the target 28; and
- p2 = the distance between the diverging lens Q3 and the target 28.

The distances w and d must be adjusted one with respect to the other in order to obtain a round beam spot on the target 28. If the distances d and q1 are to be fixed, the distance w must satisfy the following equation for this purpose:

$$w = d\{2(\alpha\beta\cdot\beta^2)/[(\beta-\alpha)^2-2\gamma d\alpha\beta]-1\} \quad (21)$$

wherein:

$$\alpha = q1z1s4-(q1+z1) \quad (22)$$

$$\beta = q2p2s6+(q2+p2) \quad (23)$$

$$\gamma = (z1s4-1)/\alpha+(p2s6+1)/\beta \quad (24)$$

wherein:

s4, s5 and s6 = the reciprocals of the focal lengths of the lenses Q1, Q2 and Q3, respectively; and $$z1 = [Hp1s5-(H+p1)]/(p1s5-1). \quad (25)$$

The values of $\alpha$, $\beta$ and $\gamma$ may be computed from Equations (22), (23), (24) and (25). Then, substituting the computed values in Equation (21), we find that the distance w approximately equals the distance d. It has now been seen that a round spot results from the system of two unipotential quadrupolar lenses 13 and 14 and one bipotential scan expansion lens 128 if the distances w and d are set approximately equal to each other.

After having been focused in the above described manner, the beam will defocus if the crossover point 124 is displaced along the tube axis with a change in the potential on the control electrode 40. In that case the beam may be refocused by correspondingly varying the potential on the refocusing lens 44. This CRT 20*d* is notable for its simplicity of construction and capability of deflection amplification.

EMBODIMENT OF FIG. 18

FIG. 18 shows a slight modification of the FIG. 13 CRT 20*b* and FIG. 15 CRT 20*c*. Positive and negative voltages +V1 and −V1 of the same absolute value are impressed to only two (e.g. first and second) of the three quadrupolar lenses 46, 48 and 50 in this modification, instead of to all of the three quadrupolar lenses as in the CRTs 20*b* and 20*c*. Positive and negative voltages +V2 and −V2 of a different absolute value are impressed to the other one (e.g. third) quadrupolar lens.

For focusing the beam at the target with this modified quadrupolar lens system, the distances w and q in FIG. 6 may be set equal to each other. Further, a1 and b1 may be set equal to a2 and b2, respectively.

POSSIBLE MODIFICATIONS

Although we have disclosed our invention in terms of several preferable embodiments thereof, we do not wish our invention to be limited by the exact details of such disclosure. The following is a brief list of modifications or alterations of the above disclosed embodiments which will occur to one skilled in the art without departing from the scope of our invention;

1. The refocusing lens may have a different number of electrodes.

2. The two outer electrodes of the illustrated three electrode refocusing lens may be at a potential different from that on the accelerating electrode.

3. The scan expansion lens system employed in some of the above disclosed embodiments may be replaced by a more conventional dome mesh.

4. The scan expansion lens system itself may be of various known types other than that disclosed herein, an example of such different types being found in U.S. Pat. No. 4,302,704 to Saito.

5. The quadrupolar lenses may be each of the known configuration shown in FIG. 14.

6. In each quadrupolar lens the pairs of opposed edges 92 and 96 of the apertures 88 and 90 may each have a more or less hyperbolic curve different from that disclosed herein.

7. In each quadrupolar lens the pairs of opposed edges 94 and 98 of the apertures 88 and 90 may not be each curved exactly like an arc and, if sufficiently spaced from the tube axis, may have any convenient shape.

8. An electrode for the correction of astigmatism may be provided in any convenient position on the target side of the accelerating electrode.

9. In the CRTs of FIGS. 1, 8, 13, 15 and 16 the quadrupolar lens 40 may be disposed on the cathode side of the vertical deflection plate pair 54.

10. In each quadrupolar lens the arrangement of the first and second groups of electrodes may be reversed; that is, one of the second group of electrodes may be disposed closest to the cathode, and one of the first group of electrodes may be disposed closest to the target.

What we claim is:

1. Apparatus including a cathode ray tube, comprising:

(a) a hermetically sealed envelope having a pair of opposite ends and a central axis extending therebetween;

(b) a target at one end of the envelope;

(c) a cathode at the other end of the envelope for emitting a beam of electrons;

(d) a control electrode disposed between the cathode and the target for directing the beam of electrons from the cathode toward the target along the central axis, the control electrode causing the electron beam to focus at a crossover point on the central axis which point is subject to change along the central axis with a variation in a potential on the control electrode;

(e) an accelerating electrode disposed between the control electrode and the target for accelerating the electron beam;

(f) deflection means disposed between the accelerating electrode and the target for deflecting the electron beam in two orthogonal directions;

(g) a series of quadrupolar lenses disposed between the accelerating electrode and the target;

(h) means for applying potentials to the quadrupolar lenses for focusing the electron beam at the target;

(i) a refocusing lens disposed between the crossover point of the electron beam and the series of quadrupolar lenses for providing a converging lens action of radial symmetry about the central axis; and (j) means including a variable potential source for applying a variable potential difference to the refocusing lens for adjustably varying the lens action thereof;

(k) whereby the electron beam, on being defocused at the target by a change in the potential on the control electrode, can be refocused through adjustment of a single potential on the refocusing lens by the variable potential source rather than through adjustment of the potentials on the quadrupolar lenses.

2. The apparatus of claim 1 wherein the refocusing lens is a unipotential lens comprising three planar apertured electrodes arranged in a row along the central axis, the outer two of the apertured electrodes being at a common potential and the central one thereof being at a lower potential.

3. The apparatus of claim 2 wherein the outer two of the apertured electrodes of the refocusing lens are electrically connected to the accelerating electrode, and the central one of the apertured electrodes is connected to the variable potential source.

4. The apparatus of claim 1 wherein the quadrupolar lenses comprises:

(a) a first quadrupolar lens disposed closest to the cathode for providing a diverging lens action in a first of the two orthogonal directions and a converging lens action in a second of the orthogonal directions;

(b) a second quadrupolar lens disposed on the target side of the first quadrupolar lens for providing a converging lens action in the first of the orthogonal directions and a diverging lens action in the second of the orthogonal directions; and (c) a third quadrupolar lens disposed on the target side of the second quadrupolar lens for providing a diverging lens action in the first of the orthogonal directions and a converging lens action in the second of the orthogonal directions.

5. The apparatus of claim 4 wherein each of the first to third quadrupolar lenses is an alternating arrangement of first and second groups of planar apertured electrodes disposed in a row along the central axis and with spacings therebetween, the first and second groups of electrodes of each quadrupolar lens being held at negative and positive potentials, respectively, which are approximately equal to each other in absolute value.

6. The apparatus of claim 5 wherein each of the first group of electrodes of the first quadrupolar lens has formed therein an aperture defined by first and second pairs of opposed edges, and wherein:

(a) the first pair of opposed edges are each curved substantially in accordance with the following equation in a cartesian coordinate system of x and y axes extending in the two orthogonal directions and intersecting at an origin located on the central axis:

$$x^2-y^2=a1^2$$

wherein a1 is the distance along the x axis between the origin and each of the first pair of opposed edges;

(b) the distance along the y axis between the origin and each of the second pair of opposed edges is generally longer than the distance a1; and (c) each of the second group of electrodes of the first quadrupolar lens has formed therein an aperture which is equivalent in shape and size to the aperture in each of the first group of electrodes except that there is an angular displacement of 90 degrees about the central axis between the apertures in the first and second groups of electrodes.

7. The apparatus of claim 6 wherein the second pair of opposed edges of the aperture in each of the first group of electrodes of the first quadrupolar lens are each curved substantially in accordance with the following equation in the cartesian coordinate system:

$$x^2+y^2=b1^2$$

wherein b1 is the distance along the y axis between the origin and each of the second pair of opposed edges.

8. The apparatus of claim 5 wherein each of the first group of electrodes of the second quadrupolar lens has formed therein an aperture defined by first and second pairs of opposed edges, and wherein:

(a) the first pair of opposed edges are each curved substantially in accordance with the following equation in a cartesian coordinate system of x and y axes extending in the two orthogonal directions and intersecting at an origin located on the central axis:

$$x^2-y^2=-a2^2$$

wherein a2 is the distance along the y axis between the origin and each of the first pair of opposed edges;

(b) the distance along the x axis between the origin and each of the second pair of opposed edges is generally longer than the distance a2; and (c) each of the second group of electrodes of the second quadrupolar lens has formed therein an aperture which is equivalent in shape and size to the aperture in each of the first group of electrodes except that there is an angular displacement of 90 degrees about the central axis between the apertures in the first and second groups of electrodes.

9. The apparatus of claim 8 wherein the second pair of opposed edges of the aperture in each of the first group of electrodes of the second quadrupolar lens are each curved substantially in accordance with the following equation in the cartesian coordinate system:

$$x^2+y^2=b2^2$$

wherein b2 is the distance along the x axis between the origin and each of the second pair of opposed edges.

10. The apparatus of claim 5 wherein each of the first group of electrodes of the third quadrupolar lens has formed therein an aperture defined by first and second pairs of opposed edges, and wherein:

(a) the first pair of opposed edges are each curved substantially in accordance with the following equation in a cartesian coordinate system of x and y axes extending in the two orthogonal directions and intersecting at an origin located on the central axis:

$$x^2-y^2=a3^2$$

wherein a3 is the distance along the x axis between the origin and each of the first pair of opposed edges;

(b) the distance along the y axis between the origin and each of the second pair of opposed edges is generally longer than the distance a3; and (c) each of the second group of electrodes of the third quadrupolar lens has formed therein an aperture which is equivalent in shape and size to the aperture in each of the first group of electrodes except that there is an angular displacement of 90 degrees about the central axis between the apertures in the first and second groups of electrodes.

11. The apparatus of claim 10 wherein the second pair of opposed edges of the aperture in each of the first group of electrodes of the third quadrupolar lens are each curved substantially in accordance with the following equation in the cartesian coordinate system:

$$x^2+y^2=b3^2$$

wherein b3 is the distance along the y axis between the origin and each of the second pair of opposed edges.

12. The apparatus of claim 5 wherein each of the first group of electrodes of the first quadrupolar lens has formed therein an aperture defined by first and second pairs of opposed edges, and wherein:

(a) the first pair of opposed edges are each curved substantially in accordance with the following equation in a cartesian coordinate system of x and y axes extending in the two orthogonal directions and intersecting at an origin located on the central axis:

$$x^2-y^2=a1^2$$

wherein a1 is the distance along the x axis between the origin and each of the first pair of opposed edges;

(b) the distance along the y axis between the origin and each of the second pair of opposed edges is generally longer than the distance a1; and (c) each of the second group of electrodes of the first quadrupolar lens has formed therein an aperture which is equivalent in shape and size to the aperture in each of the first group of electrodes of the first quadrupolar lens except that there is an angular displacement of 90 degrees about the central axis between the apertures in the first and second groups of electrodes of the first quadrupolar lens;

wherein each of the first group of electrodes of the second quadrupolar lens has formed therein an aperture defined by third and fourth pairs of opposed edges, and wherein:

(d) the third pair of opposed edges are each curved substantially in accordance with the following equation in the cartesian coordinate system of the x and y axes:

$$x^2-y^2=-a2^2$$

wherein a2 is the distance along the y axis between the origin and each of the third pair of opposed edges;

(e) the distance along the x axis between the origin and each of the fourth pair of opposed edges is generally longer than the distance a2; and (f) each of the second group of electrodes of the second quadrupolar lens has formed therein an aperture which is equivalent in shape and size to the aperture in each of the first group of electrodes of the second quadrupolar lens except that there is an angular displacement of 90 degrees about the central axis between the apertures in the first and second groups of electrodes of the second quadrupolar lens;

wherein each of the first group of electrodes of the third quadrupolar lens has formed therein an aperture defined by fifth and sixth pairs of opposed edges, and wherein:

(g) the fifth pair of opposed edges are each curved substantially in accordance with the following equation in the cartesian coordinate system of the x and y axes:

$$x^2-y^2=a3^2$$

wherein a3 is the distance along the x axis between the origin and each of the fifth pair of opposed edges;

(h) the distance along the y axis between the origin and each of the sixth pair of opposed edges is generally longer than the distance a3; and (i) each of the second group of electrodes of the third quadrupolar lens has formed therein an aperture which is equivalent in shape and size to the aperture in each of the first group of electrodes of the third quadrupolar lens except that there is an angular displacement of 90 degrees about the central axis between the apertures in the first and second groups of electrodes of the third quadrupolar lens.

13. The apparatus of claim 12 wherein the distances a1, a2 and a3 are equal to one another.

14. The apparatus of claim 12 wherein the means for applying potentials to the quadrupolar lenses comprises:

(a) a first potential source for applying a first negative potential to the first group of electrodes of the first quadrupolar lens;

(b) a second potential source for applying a first positive potential, substantially equal in absolute value to the first negative potential, to the second group of electrodes of the first quadrupolar lens;

(c) a third potential source for applying a second negative potential to the first group of electrodes of the second quadrupolar lens;

(d) a fourth potential source for applying a second positive potential, substantially equal in absolute value to the second negative potential, to the second group of electrodes of the second quadrupolar lens;

(e) a fifth potential source for applying a third negative potential to the first group of electrodes of the third quadrupolar lens; and (f) a sixth potential source for applying a third positive potential, substantially equal in absolute value to the third negative potential, to the second group of electrodes of the third quadrupolar lens.

15. The apparatus of claim 12 wherein the means for applying potentials to the quadrupolar lenses comprises:

(a) a first potential source for applying a common negative potential to the first groups of electrodes of the first, second and third quadrupolar lenses; and (b) a second potential source for applying a common positive potential, equal in absolute value to the common negative potential, to the second groups of electrodes of the first, second and third quadrupolar lenses.

16. The apparatus of claim 12 wherein the means for applying potentials to the quadrupolar lenses comprises:

(a) a first potential source for applying a first potential to the first groups of electrodes of the first and second quadrupolar lenses;

(b) a second potential source for applying a second potential, opposite in polarity to the first potential, to the second groups of electrodes of the first and second quadrupolar lenses;

(c) a third potential source for applying a third potential to the first group of electrodes of the third quadrupolar lens; and (d) a fourth potential source for applying a fourth potential, opposite in polarity to the third potential, to the second group of electrodes of the third quadrupolar lens.

17. The apparatus of claim 12 wherein the distances a1, a2 and a3 are determined in accordance with equations:

$$a2 = \sqrt{q(d+w)/w(q+d)} \cdot a1$$

$$a3 = \sqrt{pq(d+w)/dw(q+p)} \cdot a2$$

wherein:

w=the distance along the central axis between the crossover point and the center of the first quadrupolar lens;

d=the center-to-center distance along the central axis between the first and second quadrupolar lenses;

q=the center-to-center distance along the central axis between the second and third quadrupolar lenses; and p=the distance along the central axis between the center of the third quadrupolar lens and the target;

and wherein the dimensions of the first, second and third quadrupolar lenses along the central axis are equal to one another.

18. The apparatus of claim 12 wherein the distances a1, a2 and a3 are equal to one another, and wherein the dimensions L1, L2 and L3 of the first, second and third quadrupolarlenses, respectively, along the central axis are determined in accordance with equations:

$$L2=w(q+d)/q(d+w)\cdot L1$$

$$L3=dw(q+p)/qp(d+w)\cdot L1$$

wherein:

w=the distance along the central axis between the crossover point and the center of the first quadrupolar lens;

d=the center-to-center distance along the central axis between the first and second quadrupolar lenses;

q=the center-to-center distance along the central axis between the second and third quadrupolar lenses; and p=the distance along the central axis between the center of the third quadrupolar lens and the target.

19. The apparatus of claim 4 wherein the deflection means comprises first and second deflection systems spaced from each other along the central axis, and wherein the third quadrupolar lens is disposed between the first and second deflection systems.

20. The apparatus of claim 4 further comprising a scan expansion lens disposed between the deflection means and the target for amplifying the deflections of the electron beam in the two orthogonal directions.

21. The apparatus of claim 4 wherein each of the first and second quadrupolar lenses is an alternating arrangement of first and second groups of planar apertured electrodes disposed in a row along the central axis and with spacings therebetween, and wherein the third quadrupolar lens is disposed between the deflection means and the target and comprises two substantially tubular electrodes displaced from each other along the central axis and partly nested one within the other.

* * * * *